United States Patent [19]

Jackson

[11] Patent Number: 4,861,384

[45] Date of Patent: Aug. 29, 1989

[54] FLUID REMOVAL CANNISTER DEVICE

[75] Inventor: Owen E. Jackson, Scottsdale, Ariz.

[73] Assignee: Jog Corporation, Commerce, Calif.

[21] Appl. No.: 738,440

[22] Filed: May 28, 1985

[51] Int. Cl.[4] ..... B08B 11/00; B08B 11/02

[52] U.S. Cl. ..... 134/9; 15/256.6; 134/15; 210/776; 210/767; 210/353; 210/671; 210/923; 210/242.2

[58] Field of Search ..... 134/9, 15; 210/776, 210/767, 923, 924, 242.2, 353, 671; 15/256.6; 492/92; 405/60, 63, 66

[56] References Cited

U.S. PATENT DOCUMENTS

| | | | |
|---|---|---|---|
| 181,475 | 8/1876 | Purviance | 15/256.4 |
| 769,014 | 8/1904 | Pedley | 15/256.4 |
| 1,007,282 | 10/1911 | Hawley | 15/256.4 |
| 1,221,018 | 4/1917 | Bliss | 15/256.4 |
| 1,245,427 | 11/1917 | Bliss | 15/256.4 |
| 1,425,112 | 8/1922 | Long | 15/256.4 |
| 1,475,382 | 11/1923 | Gennevois | 15/256.4 |
| 1,499,386 | 7/1924 | Long | 15/256.4 |
| 1,499,387 | 7/1924 | Long | 15/256.4 |
| 2,704,981 | 3/1955 | Gustafson | 15/256.4 |
| 3,774,685 | 11/1973 | Rhodes | 166/314 |
| 4,089,178 | 5/1978 | Kinease et al. | 405/66 |
| 4,158,576 | 6/1979 | Butz | 134/7 |
| 4,234,420 | 11/1980 | Turbeville | 210/671 |

*Primary Examiner*—Asok Pal

*Attorney, Agent, or Firm*—Lyon & Lyon

[57] ABSTRACT

A fluid carrying chain is drawn through a perforated cannister containing fluid removal nodules that remove fluid from the chain.

16 Claims, 2 Drawing Sheets

FLUID REMOVAL CANNISTER DEVICE

BACKGROUND OF THE INVENTION

The field of the present invention is the recovery of fluid from fluid carrying chains.

The use of chains and other conveyor means as a fluid carrying medium to transport fluids such as oil or water is known. Such devices, generally accumulate fluid at a fluid source and deposit the fluid at a remote recovery situs. Various methods have been suggested to remove the transported fluid at the destination point. When conveyor means other than chains are employed, fluid removal has been by such means as squeegee rolls in Rhodes U.S. Pat. No. 3,774,685, scrapers in Pedley U.S. Pat. No. 769,014, and presser wheels in Hawley U.S. Pat. No. 1,007,282. When chains are employed, several fluid removal means have been suggested such as metal scrapers in Gustafson U.S. Pat. No. 2,704,981 and slit sheets in Purviance U.S. Pat. No. 181,475. Generally, however, fluid removal from chains has been by passive means such as centrifical force in Gennevois U.S. Pat. No. 1,475,382, Long U.S. Pat. Nos. 1,425,112, 1,499,387, and 1,499,386, or by gravity means in Bliss U.S. Pat. Nos. 1,245,427 and 1,221,018.

The instant invention improves upon such suggestions by providing an adjustable fluid removal apparatus for actively removing fluid from a chain.

SUMMARY OF THE INVENTION

This invention relates to a device for removing oils over a wide range of specific gravity from a chain used to recover oil from wells.

The removal of oil from chains using known removal methods may not be efficient for all applications. Use of those methods may prove problematic where certain chain link geometries are present or where the oil to be recovered is viscous. For example, when a blade or slit material is used to remove oil, much of the oil may remain on the chain depending upon chain geometry. When passive recovery means such as gravity or centrifical force are employed it may be difficult to recover oils of high viscosity. As a result, such methods are of limited application.

It is therefore an object of this invention is to provide improved means for removing oil from a chain used to recover oil from wells.

It is a further object of this invention to provide removal means for removing viscous oil from a chain.

It is still a further object of this invention to provide increased oil extracting capacity in a chain used to recover fluid from wells.

Other objects and advantages will be readily apparent from the following description.

DESCRIPTION OF THE PREFERRED EMBODIMENT

Figures 1, 2:
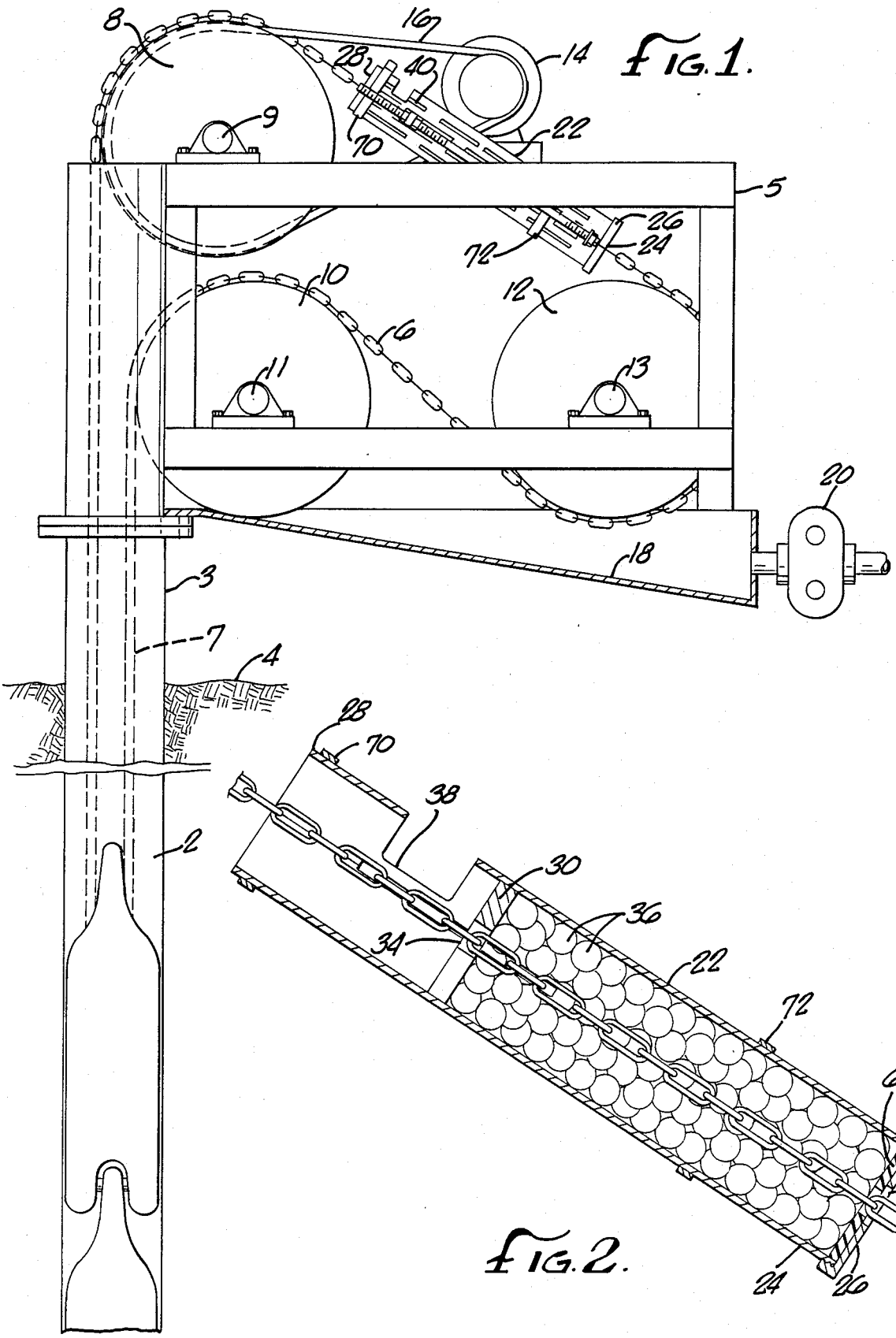
FIG. 1 is a side elevation of a system incorporating an embodiment of the present invention.
FIG. 2 is a side view of an oil recovery cannister.

Referring to FIG. 1, a well 2 may have the usual casing 3 projecting above ground level 4. A platform 5 is supported in any acceptable fashion above the ground level and has a series of sprockets 8, 10 and 12 journalled on shafts 9, 11 and 13, respectively, which shafts are rotatably supported in platform 5 in the usual manner. An endless chain 6 has a loop 7 suspended down the well casing 3 and is looped above the well around sprockets 8, 10 and 12. Drive sprocket 8 is driven clockwise by a variable speed motor 14 through belt 16. Upon leaving the well casing 3, the oil laden chain links are drawn up and over drive sprocket 8. As the chain links advance over the top of the drive sprocket 8 they dump their oil into a collecting trough 18, which oil may then be pumped out by pump 20. Depending upon the viscosity of the oil carried by the chain 6, some oil will remain on the chain after leaving drive sprocket 8. To remove the remaining oil, the device embodying the present invention may be utilized.

Figure 3:
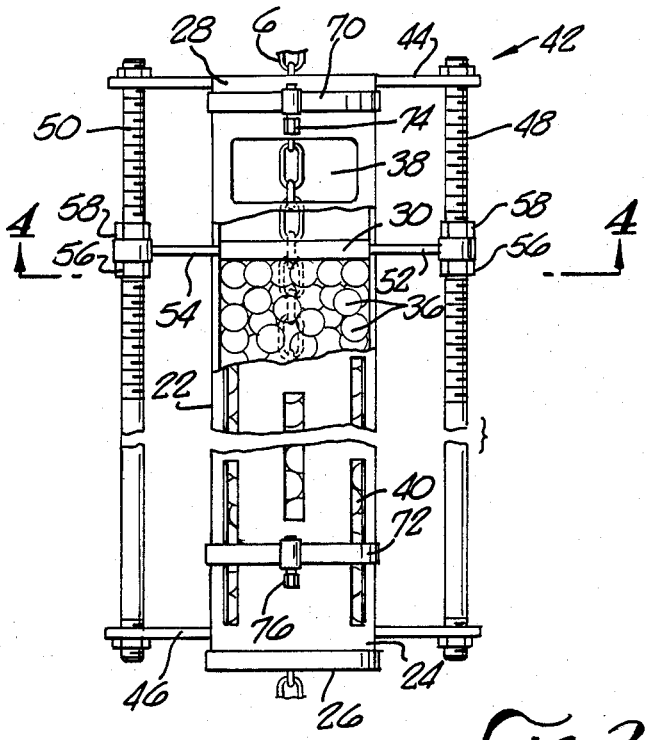
FIG. 3 is a side view of an oil recovery cannister and an adjustable press associated therewith.

Referring to FIGS. 1 and 2, chain 6 passes through cylindrical oil recovery cannister 22 substantially along the cylindrical axis thereof. Cannister 22 is provided with a closed end 24, closed by means of threaded end cap 26, and an opposing open end 28. To permit cannister 22 to be readily mounted about chain 6, the cannister may be split longitudinally. In that case, as shown in FIG. 3, adjustable bands 70 and 72 surrounding the circumference of cannister 22, having adjusting screws 74 and 76, respectively, are employed to ensure cannister integrity. Referring back to FIG. 2, slideably disposed between canister ends 24 and 28 is a plate 30. End cap 26 and plate 30 have apertures 32 and 34, respectively, to permit the passage of chain 6. Disposed within cannister 22, between plate 30 and closed end 24, are elastomeric oil removal nodules 36. The nodules 36 are easily introduced into cannister 22 by sliding plate 30 towards open end 28 and inserting the nodules through the opening 38. Plate 30 is then repositioned against the nodules forcing same against end cap 26. As the chain passes through cannister 22, the nodules scrub the oil from each chain link member. To permit the removed oil to readily escape, cannister 22 is perforated by slots 40 as shown in FIGS. 1 and 3. The removed oil drops into collecting trough 18 and is then discharged by pump 20. Depending on the flow properties of the oil and the geometry of the chain link members, the size and shape of the oil removal nodules 36 can be suitably varied. In the present embodiment, elastomeric balls are employed.

Figure 4:
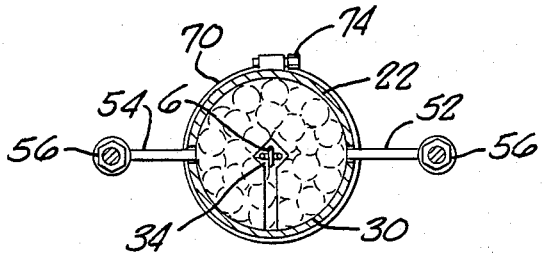
FIG. 4 is a cross-sectional view of an oil recovery cannister and an adjustable press taken along line 4—4 of FIG. 3.

The oil removal characteristics of the present device may be further controlled by placing the oil removal nodules 36 under varying degrees of compression. Referring to FIGS. 3 and 4, a press 42 is shown. The press is comprised of end members 44 and 46 that support guide posts 48 and 50. Slideably mounted to guide posts 48 and 50, by virtue of support arms 52 and 54, is plate 30. Plate 30 may be fixed in position on the guide posts 48 and 50, which in the present embodiment are threaded, by virtue of adjusting nuts 56 and 58 or by other conventional means. As plate 30 is positioned along guide posts 48 and 50, the volume occupied by the oil removal nodules 36 inside cannister 22 changes accordingly. In this manner, the compression on the nodules 36 may be suitably adjusted.

In order to further remove accumulated oil from chain 6 cannister 22 is provided with wiping plates 60. For example, as shown in FIG. 2, a wiping plate 60 may be placed at the closed end 24 of the cannister adjacent end cap 26. Other wiping plates 60 may be suitably positioned in the cannister near the open end 28 thereof.

Figure 5:
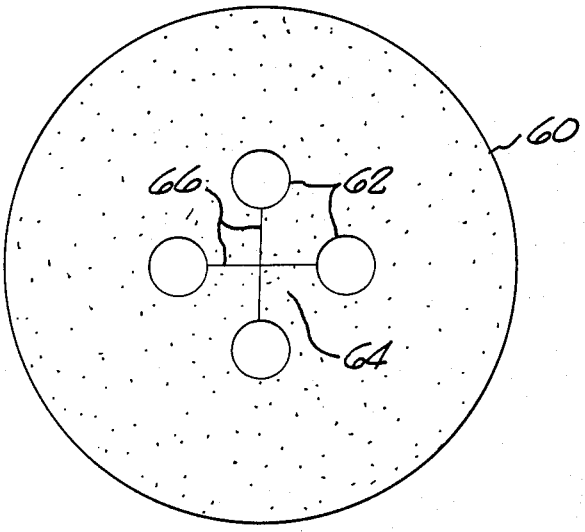
FIG. 5 is a plan view of an oil wiper plate.
Figure 6:
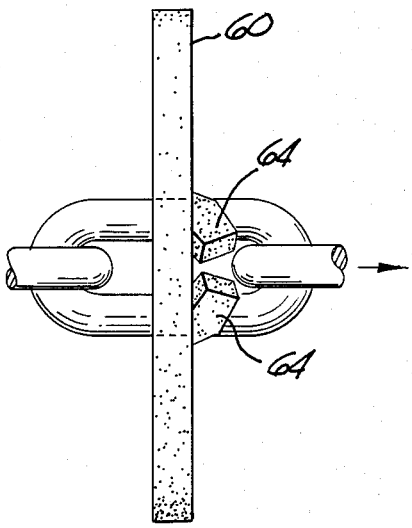
FIG. 6 is an edge view of an oil wiper plate showing a chain passing therethrough.

Turning to FIGS. 5 and 6, chain 6 passes through flexible wiper plate 60. Wiper plate 60 is made from any suitable material such as oil resistant rubber or the like. Positioned on wiper plate 60 are holes 62 to wipe oil from the sides of individual link members of chain 6 as the chain passes through. To wipe oil from the ends of the link members, plate 60 contains moveable flaps 64 formed by cross-cuts 66 extending between opposing holes 62. As shown in FIG. 6, as the end of a chain link member passes through plate 60, flaps 64 yield to the extent necessary to accommodate the link while bearing on the link to wipe fluid therefrom. Once the link member end has passed plate 60, flaps 64 will spring back into the plane of the plate to reform holes 62, which are sized to provide complete wiping of the sides of the chain link members. In this fashion, the majority of the accumulated oil on chain 6 may be retrieved.

While what hereinbefore has been described is the preferred embodiment of this invention, it is readily apparent that alterations and modifications can be resorted to without departing from the scope of this invention and such alterations and modifications are intended to be included within the scope of the appended claims.

What is claimed is:

1. A device for recovering fluid from a chain comprising:
   - a cannister positioned to envelop a portion of the chain,
   - fluids removal nodules disposed in said cannister, through which said chain is drawn, oil escape means to permit removed fluid to pass exteriorally of said cannister.

2. The device set forth in claim 1 wherein said cannister is cylindrical and said chain lies substantially along the cylindrical axis thereof.

3. The device set forth in claim 2 wherein said oil escape means are slots in said cannister.

4. The device set forth in claim 3 wherein said fluid removal nodules are elastomeric balls.

5. The device set forth in claim 1 wherein said fluid removal nodules are compressed in said cannister.

6. A device for recovering fluid from a chain comprising:
   - a cannister positioned to envelop a portion of the chain,
   - fluid removal nodules disposed in said cannister through which said chain is drawn,
   - adjustable nodule packing means to vary the volume occupied by said nodules in said cannister,
   - oil escape means to permit removed fluid to pass exteriorally of said cannister.

7. The device set forth in claim 6 wherein said cannister is cylindrical and said chain lies substantially along the cylindrical axis thereof.

8. The device set forth in claim 7 wherein said oil escape means are slots in said cannister.

9. The device set forth in claim 8 wherein said cannister is split longitudinally to permit said cannister to be mounted about said chain and wherein adjustable bands surrounding the circumference of said cannister are provided.

10. The device set forth in claim 9 wherein said fluid removal nodules are elastomeric balls.

11. The device set forth in claim 6 wherein said nodules are compressed in said cannister.

12. The device set forth in claim 6 wherein said cannister has a closed end and an opposing open end.

13. The device set forth in claim 12 wherein said adjustable nodule packing means comprise an adjustable press having a plate slidably disposed in said cannister between said closed and open ends thereof and positionable to urge said nodules against said closed end of said cannister.

14. The device set forth in claim 6 further comprising oil wiper means disposed in said cannister.

15. The device set forth in claim 14 wherein said oil wiper means comprises at least one flexible oil wiper plate through which said chain is drawn, said plate comprising holes to wipe the sides of the link members of said chain and moveable flaps formed by cross-cuts extending between opposing holes to wipe the ends of said chain link members.

16. A method for removing fluid from a chain comprising the steps of:
   - drawing the chain through a cannister having oil removal nodules disposed therein,
   - recovering the fluid removed from said chain through oil escape means in said cannister,
   - collecting the recovered fluid in an oil collecting chamber.

* * * * *